United States Patent [19]

Helmus

[11] Patent Number: 4,976,757

[45] Date of Patent: Dec. 11, 1990

[54] FILTRATION PLENUM MODULE CONSTRUCTED FOR ON-SITE ASSEMBLY

[75] Inventor: Martin C. Helmus, Wyoming, Mich.

[73] Assignee: Comp-Aire Systems, Inc., Grand Rapids, Mich.

[21] Appl. No.: 347,479

[22] Filed: May 4, 1989

[51] Int. Cl.[5] ..... B01D 46/00

[52] U.S. Cl. ..... 55/355; 55/484; 98/40.05

[58] Field of Search ..... 55/385.2, 473, 484, 55/355; 98/40.1, 40.05; 403/401, 402

[56] References Cited

U.S. PATENT DOCUMENTS

| | | | |
|---|---|---|---|
| 3,486,311 | 12/1969 | Allan, Jr. | 55/385.2 X |
| 3,808,777 | 5/1974 | Neuman et al. | 98/40.05 X |
| 3,835,606 | 9/1974 | Liberman | 98/40.1 X |
| 4,319,899 | 3/1982 | Marsh | 55/473 X |
| 4,549,472 | 10/1985 | Endo et al. | 55/385.2 X |
| 4,560,395 | 12/1985 | Davis | 55/385.2 X |
| 4,580,381 | 4/1986 | Sodec et al. | 55/484 X |
| 4,600,419 | 7/1986 | Mattison | 55/484 |
| 4,671,811 | 6/1987 | Cadwell, Jr. et al. | 55/355 |
| 4,693,175 | 9/1987 | Hashimoto | 55/385.2 X |
| 4,815,364 | 3/1989 | Wagner et al. | 403/402 X |
| 4,846,859 | 7/1989 | Nobiraki et al. | 55/355 X |

*Primary Examiner*—Harold Joyce

*Attorney, Agent, or Firm*—Waters, Morse & Harrington

[57] ABSTRACT

A filter plenum module has upper and lower peripheral frame extrusions providing vertically opposite and facing channels receiving side panels secured with fastenings traversing the inner flanges of the channels to engage the panels. Top closure panels are received on horizontal flanges of the top peripheral frame. Fastening and caulking are thus applied all from the inside, as the modules are constructed. Top panels are interconnected by reinforcing beams carried exclusively by the panels. These beams provide the principal support for the grid beams supporting the filter units. The peripheral beams also carry terminals that can be selectively placed to support the plenum assembly, according to the conditions available in the ceiling structure at the point of installation. Angle members are inserted in receptacle channels at the mitered corners of the peripheral beam extrusions for initial alignment.

12 Claims, 5 Drawing Sheets

FILTRATION PLENUM MODULE CONSTRUCTED FOR ON-SITE ASSEMBLY

BACKGROUND OF THE INVENTION

Evolution in the design of "clean rooms" has resulted in the general use of modular filter units that can be incorporated into customized or standard plenum structures. The general function of this assembly is to subject all the air coming into a room to the action of high-efficiency filters to remove all airborne particles in excess of a specified size. A completely site-constructed plenum, where parts are all cut from stock and processed at the point of installation, is always expensive, as the use of special machinery and cutting fixtures common in factory operations is not practical. This situation has resulted in the development of larger and larger fully prefabricated filtration modules including the plenum and its structure that supports the filter units. There comes a limit to this line of development, however, and this is due to the problems and cost involved in shipping large units from the factory to the point of installation, and then securing them in place. Widths have a practical maximum of eight feet, due to highway restrictions. Handling a structure this wide, three or four feet high, possibly over twenty feet long and weighing several tons, can easily dissipate the efficiency resulting from factory construction.

It is now clear that this process of design evolution must take a new turn. Other industries, faced with this same problem, have tended to shift over to prefabricated components readily assembled on site without extensive machining or processing. This results in handling components of more reasonable size, and vastly increasing the load density on trucks by removing the need to transport large volumes of the empty space within the modules. The present invention is directed at the formation of a structure capable of this type of construction at a high order of efficiency, while still complying with strict clean air requirements that forbid leakage around the filter units. These modules must be able to accommodate suspension from various ceiling structures, and have a wide range of design flexibility with regard to providing units of different sizes from essentially the same components.

SUMMARY OF THE INVENTION

This filtration module has upper and lower peripheral frames providing facing channels for receiving side panels. The inner flanges of these channels are accessible from the inside for receiving fastenings extending into the panels, and presenting interengaging surfaces that are easily caulked from the same position. Top panels are supported on horizontal shelves integral with the upper peripheral frame, and are similarly accessible to receive fastenings and caulking from the inside. The top panels are strengthened by beams at the junctions of the top panels, and fastenings securing the panels to these beams are also accessible at the inside of the plenum when it is under construction. These beams are independent of the peripheral frames. The filtration units are carried by a grid of beams suspended in part from the top panel beams, and in part supported by the lower peripheral frame. The frames are aligned at the corners by angular members engaging special-purpose channels in the frame extrusions.

DESCRIPTION OF THE PREFERRED EMBODIMENTS

Figure 1:
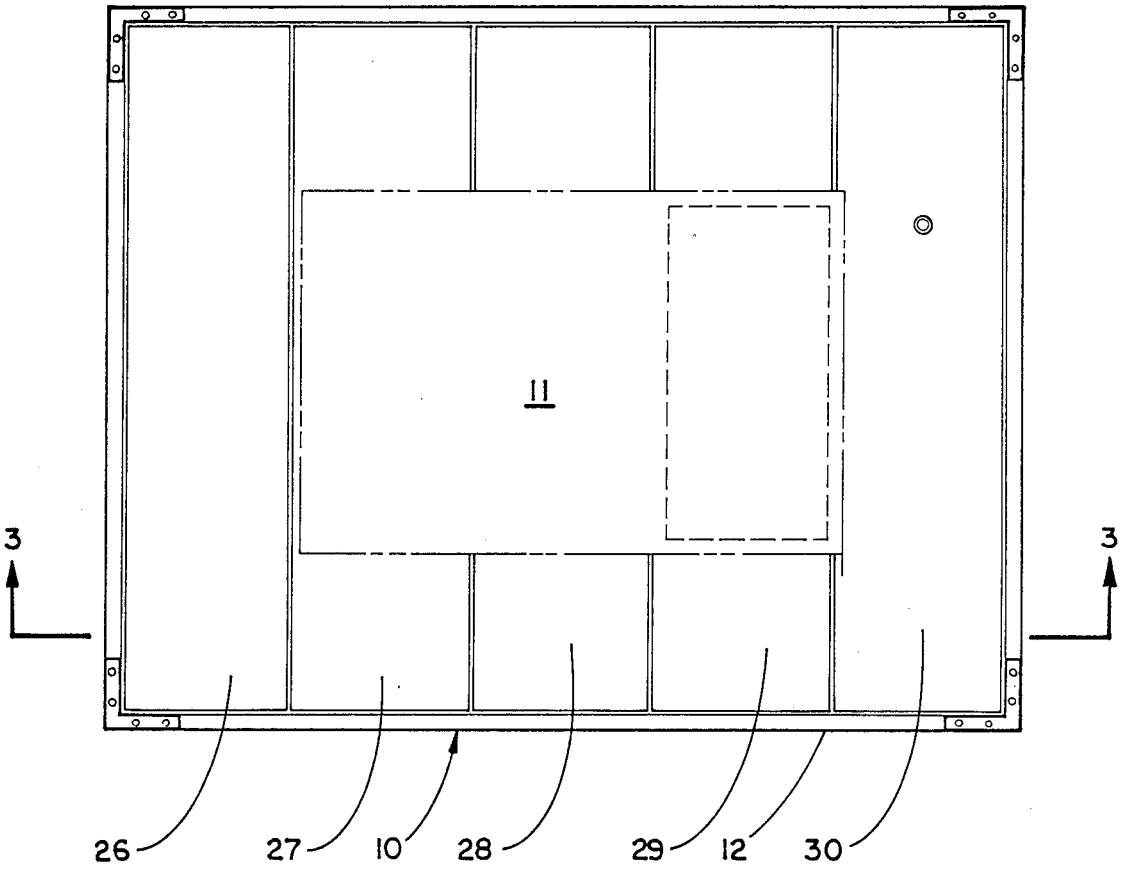
FIG. 1 is a top view of a modular plenum involving the present invention.
Figure 2:
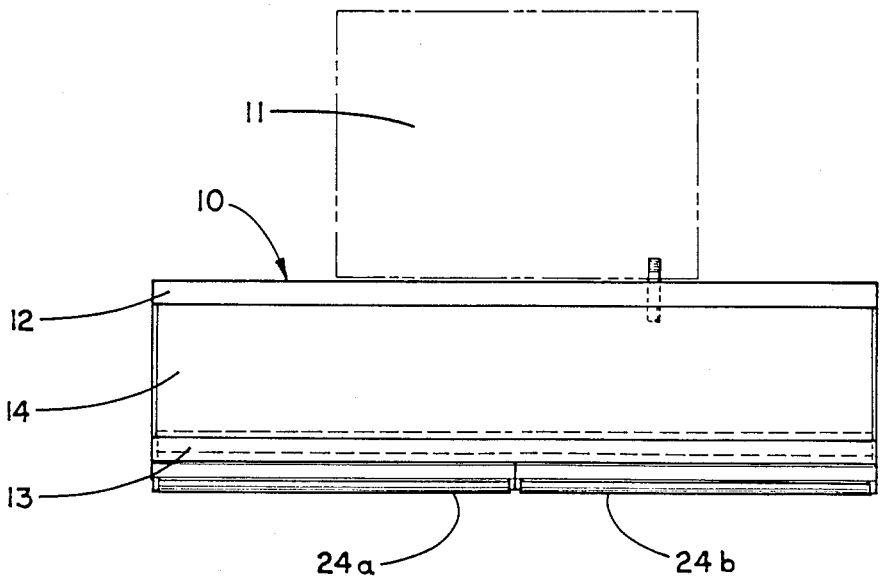
FIG. 2 is an end view of the structure shown in FIG. 1.
Figure 3:
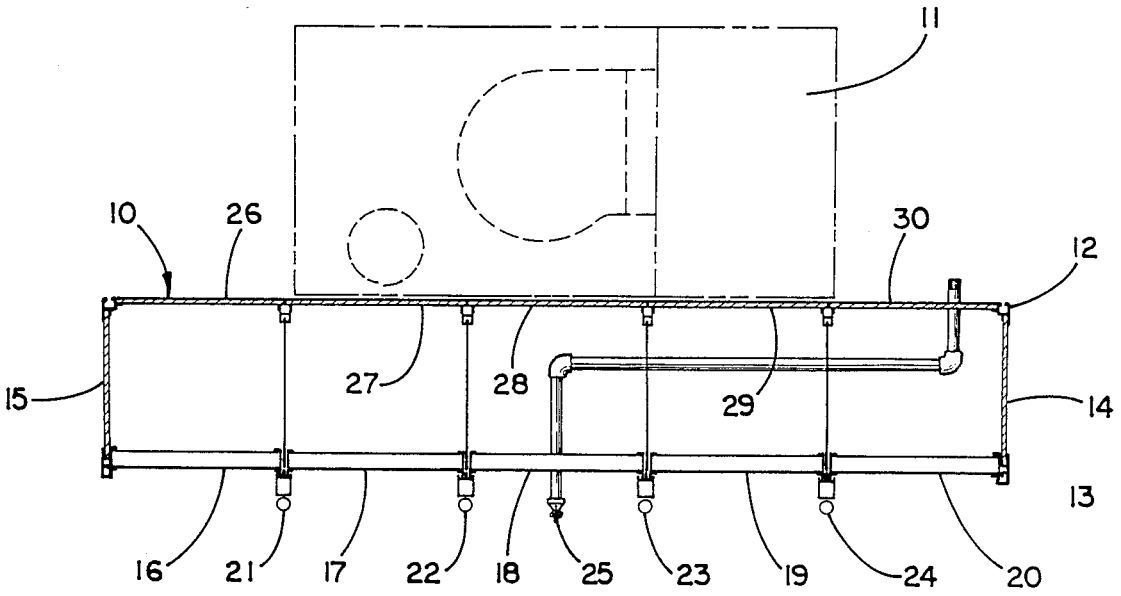
FIG. 3 is a section on the plane 3—3 of FIG. 1.

Referring to FIGS. 1, 2, and 3, the filtration plenum module indicated generally at 10 may be provided with a blower system shown in dotted lines at 11 for generating a positive pressure within the module relative to the ambient pressure within the room in which the module is installed. Alternatively, a pressure duct (not shown) may be connected to the module as a source of the air pressure. The module includes the upper and lower peripheral frames 12 and 13, respectively, and a group of side panels as shown at 14 and 15 in FIG. 3 forming a closure around the module, and extending between the upper and lower peripheral frames. The module supports a group of standard HEPA filter elements at shown at 16–20 in FIG. 3 through which the air within the plenum is forced. This provides the room below the plenum with the "clean air" required by many industrial and laboratory processes. Optionally, the plenum may also include a group of light fixtures as shown at 21–24, and the sprinkler installation indicated at 25 for the reduction of fire hazards. The top of the plenum is closed off by the rectangular panels 26–30. A suitable opening in a selected one or more of these panels is provided for the air supplied by the blower system 11.

Figure 4:
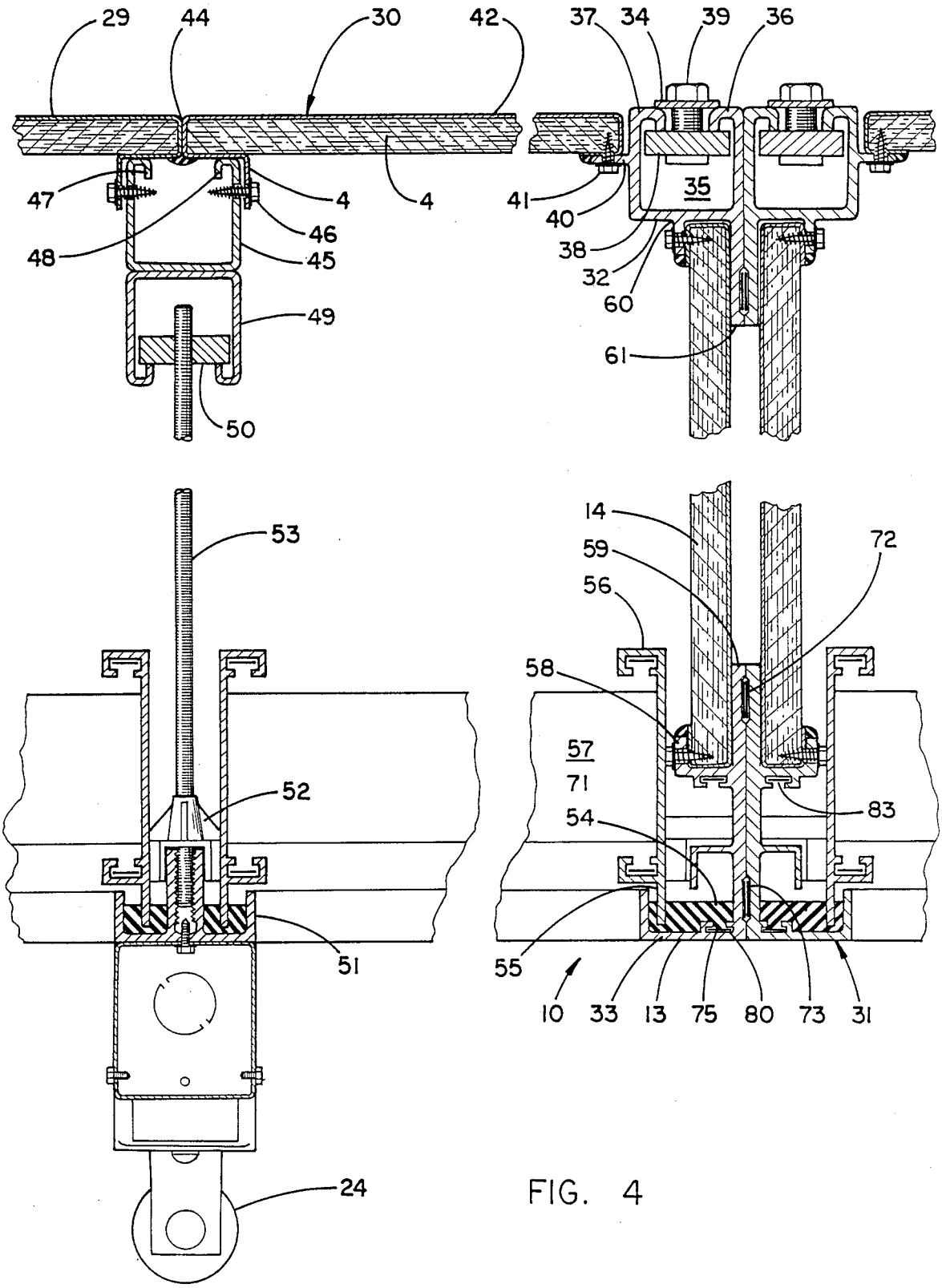
FIG. 4 is an enlarged fragmentary section showing the structural details of the plenum.

The interior structure of the plenum module is best shown in FIG. 4, which illustrates the junction between the module 10 and a similarly-constructed module 31. The upper peripheral frame is formed by the extrusion 32, and the lower peripheral frame by the extrusion 33. The ends of these extrusions will normally be mitered at the corners of the module, and these corners are secured by angle plates as shown at 34 in FIG. 4. The upper portion of the extrusions 32 is formed by an upwardly-open channel 35 having the inwardly-turned flanges 36 and 37. A terminal block 38 similar to a weldnut is free to slide along the rails provided by the flanges 36 and 37, and is engaged by the bolts 39 securing the corner angles 34. Other terminal blocks similar to the block 38 can be positioned opposite selected components of the ceiling structure of the room to carry the weight of the module. Threaded rods of a length appropriate to the distance from the module up to the ceiling will engage these terminal blocks.

The upper extrusion 32 also has a horizontal shelf 40 supporting the top panel 30, which is secured in place by screws as indicated at 41. The top panels, and the side closure panels as well, are of sheet aluminum, as shown at 42. A layer of fiberglass insulation 43 is bonded to the aluminum 42 to inhibit heat and sound transfer. The opposite edge of the panel 30, at the junction with the panel 29, has an offset flange 43 disposed in a vertical plane set back from the panel junction 44, where the panel is secured to the junction beam 45 by the self-tapping screws 46. The junction beam 45 is preferably a rolled steel member having the in-turned flanges 47 and 48. The beam 45 has a generally U-shaped configuration, and a similar beam 49 is spot-welded along the closed sides of the cross section to provide a downwardly-open channel for receiving the terminal blocks 50. A grid of filter-supporting beams 51 is secured at their junctions by cast members as shown at 52, and these are engaged by the threaded rods 53 extending to the terminal blocks 50. The filter-supporting grid is thus supported primarily by the junction beams formed by the channels 45 and 49, which are secured exclusively to the top panels of the module, and do not need to be secured to the upper peripheral frame. When the top and side panels are in assembled position, they are caulked with a standard sealant to seal off any flow from the interior outward at the various junctions of the components of the module. The caulking is normally done on the inside of the module during assembly, and the module's structure facilitates the application.

The lower peripheral frame 13 formed by the extrusions 33 provides an upwardly-open channel for receiving a sealant indicated at 54. The vertical flange 55 of the frame 56 of the filter unit dips into the sealant 54 to provide a positive seal against any flow of air around the filter mass indicated at 57. The lower peripheral frame also has the parallel flanges 58 and 59 forming an upwardly-open channel vertically opposite the similar channel formed by the flanges 60 and 61 of the upper extrusions 32. These facing channels receive the side panels forming the peripheral closure of the module. These panels are secured by screws and caulked in the same manner as are the top panels.

Figure 8:
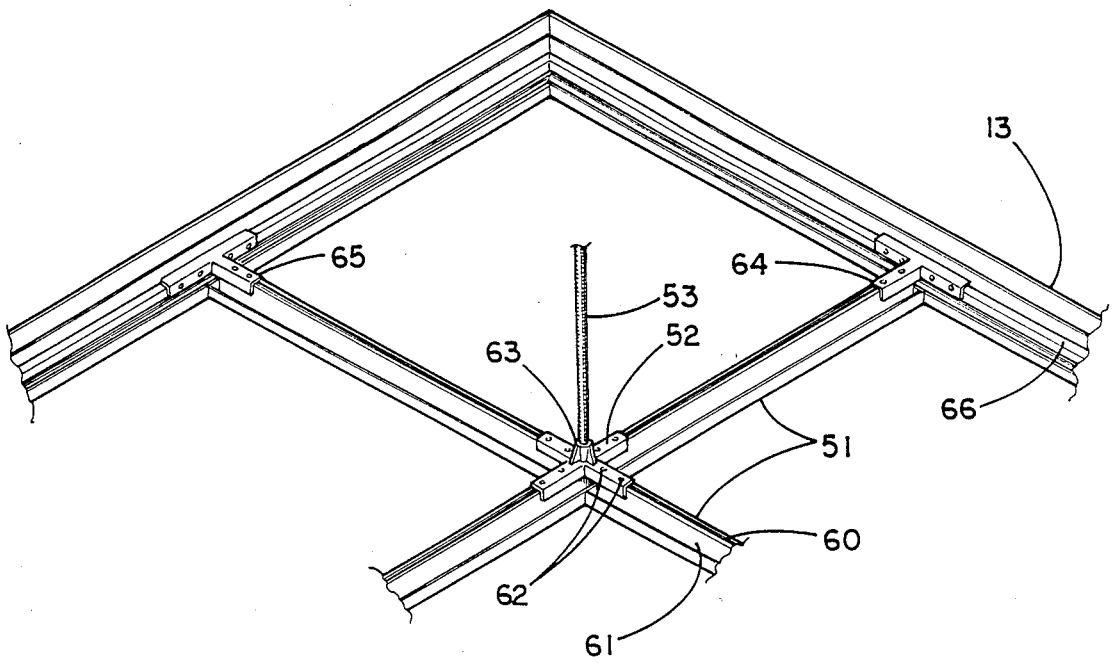
FIG. 8 is a fragmentary perspective view showing the junction of the components of the filter-supporting grid frame with the lower peripheral frame of the plenum.

Referring to FIG. 8, the grid of filter-supporting beams 51 is connected together at the beam intersections by the cross-shaped castings 52, in which the cross configuration is formed by downwardly-open channels that embrace the tops of the beams 51. The spaced flanges 60 and 61 of the beams 51 are serrated on the inner surfaces in a staggered pattern that conforms to the standard thread spacing of bolts as shown at 62 traversing the channels, and engaging the ridges on the inside of the flanges 60 and 61. The central boss 63 of the fitting 52 is threaded internally to receive the rod 53 extending upward to the terminal block in the junction beams secured to the cover panels of the module. The beams 51 may be continuous in any one direction, with the beams perpendicular to it formed by short sections interconnected by the junction fittings 52. At the peripheral frames, T-shaped fittings as shown at 64 and 65 are secured to the horizontal shelves 66. Since the flanges 55 of each of the filter units is continuous around its entire periphery, the channels containing the sealant must be continuous around both the lower peripheral frame and the grid beams. This requires that appropriate notches be made in the flanges forming these sealant channels at these points of intersection. Since this sealant is initially quite flowable, it is advisable to close off any gaps such as occur at the notched-out junctions of the grid beams with the lower frame, and at the bevelled corners of the lower frame members. This can be done by the application of tape, or by special patches that retain the sealant in the troughs until the sealant develops increased viscosity.

Figure 6:
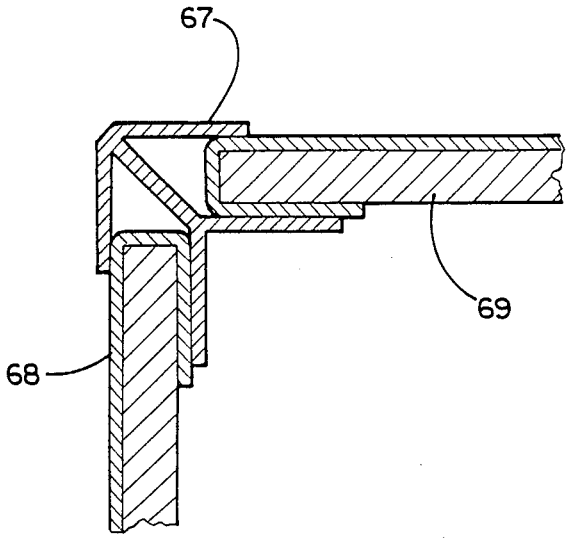
FIG. 6 is a horizontal section at the corner of the plenum, showing the engagement of the side panels with a corner extrusion.
Figure 7:
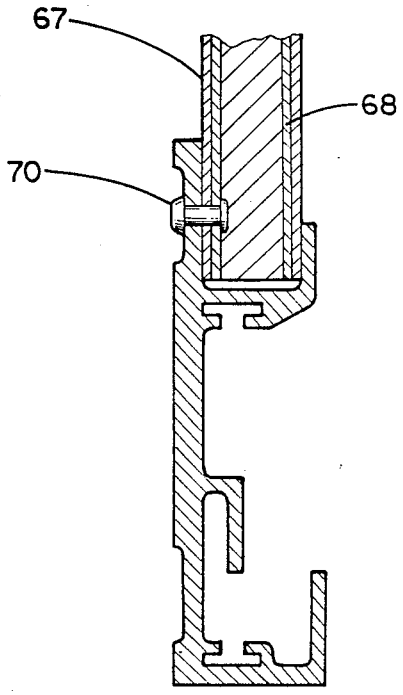
FIG. 7 is a section showing the retention of the corner extrusions in the peripheral frames.

At the corner junctions of the side panels of the module, the structure shown in FIG. 6 and 7 is used. A sealable junction of the side panels is provided by the corner extrusion 67, which provides mutually perpendicular channels for receiving the ends of the adjacent side panels 68 and 69. The extrusions 67 enter into the facing channels in the upper and lower peripheral frames, which are wide enough to accept the thickness of the extrusion walls along with the thickness of the panels. Blind rivets as shown at 70 in FIG. 7 traverse appropriate holes in the frame extrusions and in the aluminum sheets of the panels, and are expanded within the panel insulation. On some occasions, the side panels have to be spliced at intermediate points around the periphery of the module, and this is done with a conventional H-shaped extrusion (not shown) entering into the frame channels in the same manner.

Where plenum modules are secured together as shown in FIG. 4 to form a large plenum installation, holes are drilled in the mating sections of the lower peripheral frame on an axis positioned approximately as shown at 71. To seal this juncture properly, gaskets as shown at 72 and 73 are interposed between the lower peripheral frames of the two joined modules, so that the tightening of bolts along the axis of 71 will provide an adequate seal. Where modules are interconnected to form a single large plenum, the abutting end panels are eliminated to form an unobstructed air space.

Figure 5:
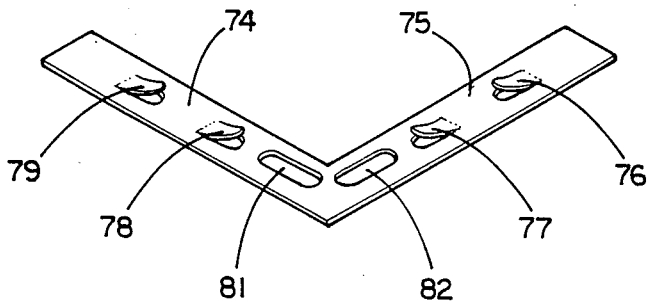
FIG. 5 is a perspective view of one of the corner alignment angles.

The assembly procedure for these plenum modules will vary somewhat with the conditions at the point of installation and with the size of the modules. All of the components will be pre-drilled, so that the parts can be put together in the manner of the familiar Erector set. In most cases, the module will be constructed upside down, with the upper peripheral frame resting either on the floor or on appropriate horses that will place the structure at a more convenient working level. The design of the components that have been described is such that all of this work can be done in this position, working from the inside of the plenum. Probably after the installation of the filter-supporting grid, the module is inverted, and hoisted into place. The suspension rods leading to the ceiling structure are installed, and the unit is then ready to receive the standard filter units. Any further special work is easily performed prior to the installation of these units, as the workmen (standing on some form of ladder or platform) can work with head and shoulders extending through the spaces between the grid beams. In most cases it will be possible to completely prefabricate the upper and lower peripheral beams including the application of the sealing material 54, at the factory, these being shipped flat to the point of installation. The side panels and the other structure are then added. During the initial manufacture of the peripheral frames, the frame extrusions are mitered at the corners, and aligned at these junctions with the alignment angles shown in FIG. 5. These are in the configuration of a right angle, and are made from spring steel preferably twenty or thirty thousandths of an inch in thickness. Each of the legs 74 and 75 are lanced to provide projections as shown at 76–79. The legs 74 and 75 enter into alignment channels as shown at 80 in FIG. 4 in the lower frame extrusions, and the presence of the lanced-out portions 76–79 provides a differential force between the insertion and the withdrawal of these members. It is preferable that the channels 80 are proportioned so that the legs 74 and 75 have to be pounded into place. They will normally be inserted with the projections extending downward, as the channels 80 have an opening on the upper side that is necessary in the design of the extrusion dies. Once these angular pieces are firmly in place, the beveled junctions of the frame extrusions are temporarily aligned so that the exterior corner angles can be applied to complete the frame security. It is also preferable to include the dimpled areas 81 and 82 in these alignment angles so that the full depth of the channel 80 is occupied, and thus assure a more effective alignment. The upper of these two installations shown in FIG. 4 is indicated at 83.

I claim:

1. A modular filter plenum, comprising:

an upper peripheral frame having a cross-section providing a downwardly-open channel defined by spaced inner and outer vertical flanges, and also providing a horizontal inner shelf;

a lower peripheral frame having a cross-section providing an upwardly open first channel defined by spaced vertical inner and outer vertical flanges, and in vertical alignment with said downwardly-open channel, and also providing an upwardly open sealing channel disposed below said first channel, said lower peripheral frame having means adapted to receive and support filter elements engaging said sealing channel;

vertical panels having the vertically opposite edges thereof received in said downwardly open and first upwardly open channels, respectively;

horizontal panel means received on said shelf; and securing means traversing said inner flanges and shelf, and engaging said panels, respectively.

2. A plenum as defined in claim 1, wherein said upper peripheral frame cross-section additionally has an upwardly open suspension channel disposed above said downwardly-open channel, said suspension channel having means forming flanges at the upper portion of said suspension channel and extending from the opposite sides of said suspension channel toward the center thereof, said plenum further including at least one terminal block received in said suspension channel and slidably confined by said suspension channel flanges.

3. A plenum as defined in claim 2, additionally including suspension terminal means slidably received in said suspension channel, and retained therein by said flanges thereof.

4. A plenum as defined in claim 1, wherein said horizontal panel means have adjacent edges provided with offset flange configurations terminating in vertical flange sections set back from said edges, respectively, and additionally including beam means received between said flange sections, and also including fastening means traversing said flange sections and engaging said beam means.

5. A plenum as defined in claim 4, wherein said beam means are independent of said upper peripheral frame.

6. A plenum as defined in claim 4, wherein said beam means includes a downwardly-open channel having flanges adjacent the lower extremities thereof, and also including terminal means slidably supported on said latter flanges, and suspension rod means connecting said terminal means to said lower peripheral frame.

7. A plenum as defined in claim 6, additionally including a filter-supporting grid suspended, at least in part, from said terminal means.

8. A plenum as defined in claim 7, wherein said beam means is a pair of back-to-back channels, one above the other, the lower of said channels being downwardly open.

9. A plenum as defined in claim 7, wherein said peripheral frames are constructed from extruded members joined at mitered ends and having coplanar receptacle channels with end openings meeting at said mitered ends, and also including angle members having legs engaging said receptacle channels in a close fit to maintain corner alignment of said extruded members.

10. A filter plenum, comprising:

a plurality of interrelated modules each having:

an upper peripheral frame with a cross-section providing a downwardly-open channel defined by spaced inner and outer vertical flanges, and also providing a horizontal inner shelf;

a lower peripheral frame with a cross-section providing an upwardly-open first channel defined by spaced vertical inner and outer flanges, and in vertical alignment with said downwardly-open channel, and also providing an upwardly-open sealing channel disposed below said first channel;

horizontal panel means received on said shelf;

securing means traversing said shelf and engaging said horizontal panels; and closure means surrounding certain sides of said plenum, at least certain of said modules having the space therein freely intercommunicating, said modules having abutting sections of said peripheral frames secured together with gasket means interposed therebetween.

11. A modular filter plenum, comprising:

an upper peripheral frame;

a lower peripheral frame;

side panel means secured to said peripheral frames;

a plurality of top panels secured to said upper peripheral frame;

a filter-supporting grid formed by beams having the axes thereof disposed in intersecting vertical planes, at least one of said beams being in vertical alignment with the junction between certain of said top panels;

grid-suspension beam means secured to at lest one of said certain top panels at said junction; and suspension means extending from said suspension beam means to said grid.

12. A modular filter plenum as defined in claim 11, wherein said upper and lower frames have vertically-aligned flanges and said side panels are secured thereto, and said upper frame has a horizontal shelf receiving said top panels, said suspension beam means being secured to both of said top panels.

* * * * *